US008467699B2

(12) United States Patent
Gonzales Perez et al.

(10) Patent No.: US 8,467,699 B2
(45) Date of Patent: Jun. 18, 2013

(54) REMANUFACTURED TONER CARTRIDGE WITH ADDED PRIMARY CHARGE ROLLER CLEANER, AND METHODS

(75) Inventors: Jesus Gonzales Perez, Chatsworth, CA (US); Yoel Wazana, Chatsworth, CA (US)

(73) Assignee: Wazana Brothers International, Inc, Van Nuys, CA (US)

( * ) Notice: Subject to any disclaimer, the term of this patent is extended or adjusted under 35 U.S.C. 154(b) by 426 days.

(21) Appl. No.: 12/756,913

(22) Filed: Apr. 8, 2010

(65) Prior Publication Data

US 2011/0249983 A1 Oct. 13, 2011

(51) Int. Cl.
*G03G 21/10* (2006.01)

(52) U.S. Cl.
USPC ..... 399/109; 399/115; 399/351; 399/360

(58) Field of Classification Search
USPC ..... 399/100, 109, 115, 350, 351, 357–360
See application file for complete search history.

(56) References Cited

U.S. PATENT DOCUMENTS

| | | | | |
|---|---|---|---|---|
| 5,583,625 | A * | 12/1996 | Kondoh | 399/358 |
| 5,697,021 | A * | 12/1997 | Watanabe et al. | 399/102 |
| 6,088,551 | A | 7/2000 | Satoh et al. | |
| 6,621,996 | B1 * | 9/2003 | Meyer et al. | 399/109 |
| 7,356,778 | B2 | 4/2008 | Piotrowski et al. | |
| 7,630,664 | B2 | 12/2009 | Ozawa et al. | |

* cited by examiner

*Primary Examiner* — Walter L Lindsay, Jr.
*Assistant Examiner* — Jessica L Eley

(57) ABSTRACT

A remanufactured laser printer toner cartridge with an added primary charge roller cleaner, and methods of remanufacture, are disclosed. The added primary charge roller cleaner may be fastened to the mounting bracket of the toner cartridge's wiper blade, and functions to remove contaminants from the primary charge roller through contact with the primary charge roller.

20 Claims, 11 Drawing Sheets

REMANUFACTURED TONER CARTRIDGE WITH ADDED PRIMARY CHARGE ROLLER CLEANER, AND METHODS

TECHNICAL FIELD

The invention relates generally to remanufactured toner cartridges, and particularly to methods and apparatus for cleaning the primary charge roller in a remanufactured laser printer toner cartridge.

BACKGROUND

Toner cartridges for laser printers are well known in the art. Generally, a cartridge will include sufficient toner for a large number of "typical" prints, such as 10,000 or 25,000, packaged in a housing which also contains those printing components that require periodic replacement, such as a photosensitive drum, magnetic and charging rollers, a "doctor" blade and a cleaning blade. The printing components and housing typically have a usable life, if properly cleaned and maintained, that greatly exceeds the number of prints for which toner is provided. Hence, toner cartridges are often remanufactured with a new supply of toner.

Remanufactured toner cartridges are both cost effective for consumers and environmentally sound. Original Equipment Manufacturers (OEMs) of printing equipment often provide "recycling" programs that allow consumers to return empty toner cartridges; the returned cartridges are shredded to recover some of the raw materials. Remanufacturing, in contrast, directly reuses most of the components of the cartridges, thereby greatly reducing the amount of material ending up in landfills, and having a substantially better "carbon footprint" than "recycling".

In a typical laser printer, a revolving photosensitive drum or belt having a surface capable of holding a localized static charge is "charged" to a uniform voltage; a modulated laser is then scanned across the surface to remove the charge from those areas which are intended to be blank in the final image. A layer of toner, in the form of a fine powder, is formed on a developing roller or magnetic roller with a "doctor blade" and is then applied to the belt or drum; the toner adheres to those areas of the belt or drum that have retained a charge. The drum or belt then deposits the toner on a print medium (such as paper), and residual toner is wiped off the drum or belt by a "cleaning" or "wiper" blade.

In early generations of laser printers, the initial charge on the belt or drum was provided by corona wires. Newer printers typically use a roller mechanism, usually called the Primary Charge Roller (PCR), to charge the drum. The shift from corona wires to PCRs helped alleviate several problems associated with early laser printers, including high ozone emissions and "corona" streaks on prints attributed to the wires.

The PCR is generally a small diameter roller made of a compliant material, and having an outer surface adapted to transfer an electrostatic charge to the photosensitive drum. The PCR is held against the drum or belt, with the movement of the drum or belt causing to PCR to rotate. Typically, the primary charge roller is charged with both an alternating current signal, which functions to remove any residual or "ghost" static charges on the drum left from previous images, and a direct current bias, which functions to charge the surface of the drum or belt to a uniform voltage. The amplitude of the uniform direct current bias voltage to a large extent determines the darkness of the final prints.

Although replacement parts are generally readily available in the cartridge remanufacturing industry, it is common for cartridge remanufacturers to clean and reuse the cartridge's original PCR roller.

A challenge faced by toner cartridge remanufacturers is variability among components available for use in remanufactured cartridges. Components may be of varying ages, minor engineering changes may have been made between production runs of a cartridge, or it may be necessary to use a combination of refurbished parts and new replacement parts.

The toner used in a remanufactured cartridge can also vary from that used by the OEM. While the remanufacturer will typically specify a toner that essentially matches the important performance characteristics of the OEM toner, and therefore provides a print quality close to the OEM toner, toner formulations are complex, involving many production steps and constituents. Some aspects of the OEM toner may be covered by patents, or different toner additives may be used due to availability or cost.

The OEM has the ability to "fine tune" the printing system, including the components in the cartridge, the toner, and the operation of the printer itself, including various initialization and cleaning operations. The OEM may, for example, formulate the materials of the photosensitive drum, the cleaning blade, and PCR such that the printing system functions reliably for the number of prints provided by the original supply of toner, but not necessarily for the extended life of a refilled cartridge. The OEM may also utilize coatings or treatments on the components which are substantially degraded due to wear by the end of the original "life" of the cartridge.

The wear on components and differences in toner formulations may result in prints produced with a remanufactured cartridge exhibiting print defects over time. For example, prints may begin to show a gray background haze. Investigations have shown one cause of the haze to be a polymeric residue that forms on the PCR, apparently from toner additives, such as wax and cleaning agents.

Repeating defects may also appear which occur on the printed page at a frequency corresponding to the circumference of the PCR. These defects can be caused by small residual amounts of toner that are not removed from the photosensitive drum by the cleaning blade, and which are subsequently deposited on the PCR. Small spots of toner thus form on the PCR roller, which are compressed each time the spot contacts the photosensitive drum, rendering the spots essentially permanent. Since the portion of the drum contacted by the spot will not be properly charged, the resulting prints will show a recurring dark spot running down the page.

Some laser printer cartridges include PCR cleaning mechanisms, although in cartridges intended for a single use this may consist only of a simple strip of film which contacts the PCR roller. Experience with remanufactured cartridges show that a basic PCR cleaner of this nature is relatively ineffective in preventing the kind of print defects often observed with remanufactured cartridges.

There is thus a need for remanufactured toner cartridges which do not exhibit print defects attributable to PCR roller contamination, and methods.

SUMMARY

The methods and apparatuses described below overcome drawbacks of known remanufactured printer cartridges by providing alternate methods and apparatus for directly removing the contaminants from the PCR, and thus to avoid or minimize printing defects associated with PCR contamination.

Embodiments include use of an added strip of material placed adjacent to the PCR that functions to wipe the PCR and remove contaminants, or use of a brush or squeegee to wipe the PCR and remove contaminants from the PCR.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein, although the components, aspects or features are not necessarily identical.

DETAILED DESCRIPTION

With reference to FIGS. 1-10 several embodiments of methods and apparatus useful in cleaning the PCR of laser printer toner cartridges will be described.

The remanufacturing of laser printer toner cartridges typically entails disassembling spent cartridges, cleaning or replacing components as necessary, reassembling the cartridge, and refilling the cartridge with toner. Embodiments of the invention involve modifying the cartridge by the addition of a cleaning mechanism for the Primary Charge Roller (PCR).

Figure 1:
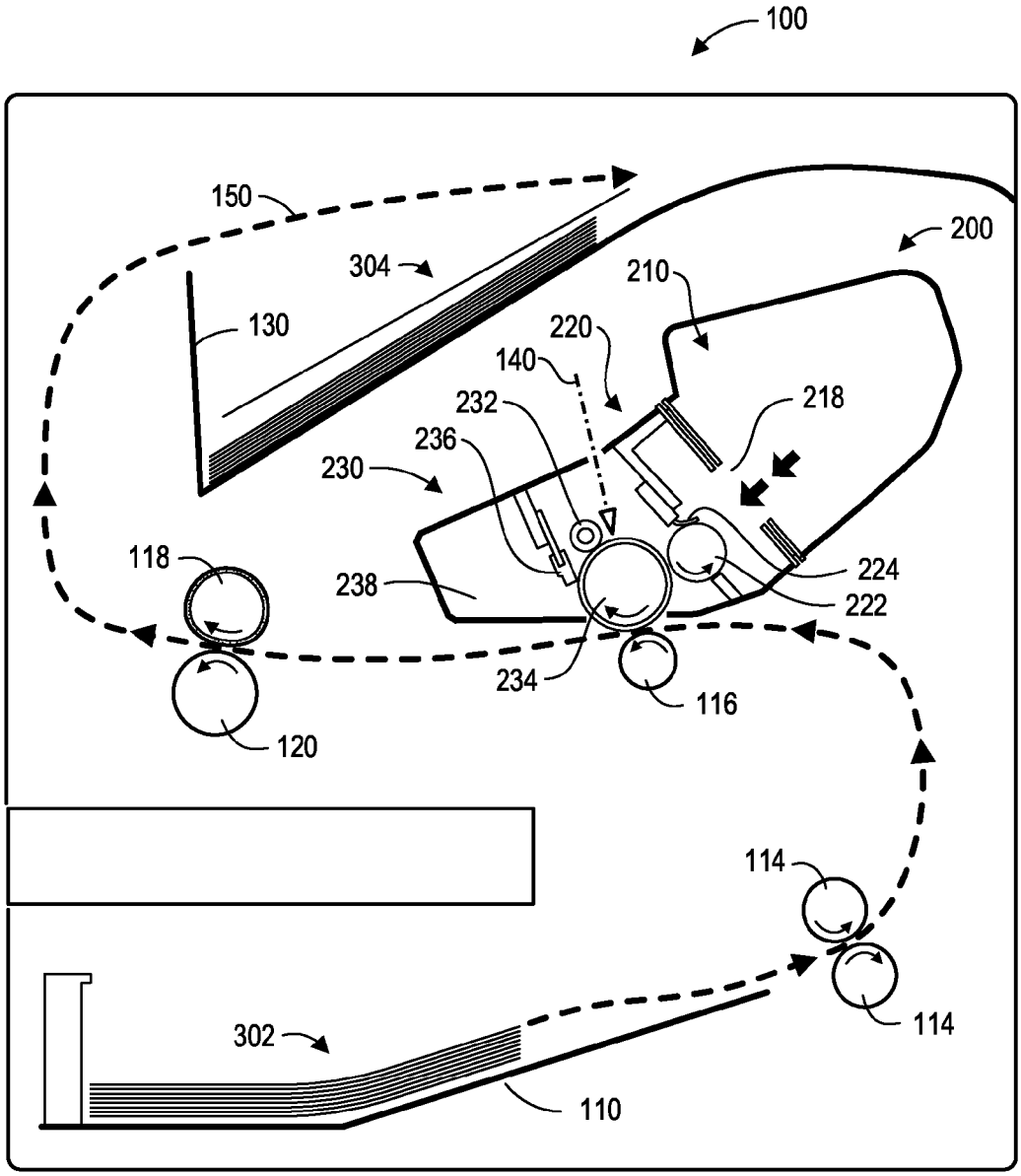
FIG. 1 is a schematic diagram illustrating in cross section an exemplary laser printer and toner cartridge.

FIG. 1 schematically illustrates in cross section an exemplary laser printer and toner cartridge. The printer 100 includes an input hopper 110 for blank print media 302 such as paper; media handling mechanisms 114 for transporting print media through the printer; print cartridge 200; transfer roller 116; fixing sleeve 118 and pressure roller 120 for fusing toner to the media; and an output media tray 130 for receiving printed media 304. The media path through the printer is denoted by the heavy dashed line 150. FIG. 1 is a simplified representation, and a typical laser printer will include multiple media paths that route print media past the print cartridge. Not shown in FIG. 1 are the printing electronics and the writing laser.

Exemplary toner cartridge 200 is made up of multiple modules, which are typically separated during the remanufacture of the cartridge. The modules may, for example, include a toner hopper assembly 210, a magnetic roller section chassis 220, and a waste hopper assembly 230. Some cartridge types may consist of fewer modules; for example, the functions of the toner hopper and magnetic roller section may be combined into a single module. Various methods are typically used to join the modules, including mechanical fasteners and ultrasonic welding. In some exemplary toner cartridges the modules are also connected by cartridge end plates (not illustrated in FIG. 1) which add strength and to the cartridge and protect mechanical components, such as gear trains.

The toner hopper module 210 provides storage for a supply of fresh toner for the printer, which passes through an opening 218 in the hopper to the magnetic roller section chassis 220 for utilization by the printer. During printing, the magnetic roller 222 and "doctor" blade 224 mounted in the magnetic roller section chassis serve to meter toner received from the toner hopper onto the photosensitive drum 234 of the cartridge. Toner adheres to the rotating magnetic roller 222; the level of toner deposited on the magnetic roller and then the photosensitive drum is primarily controlled by a doctor blade 224.

The waste hopper assembly 230 of the exemplary toner cartridge includes a primary charge roller (PCR) 232, the photosensitive drum 234, a wiper blade 236, and a waste toner hopper compartment 238. In an exemplary toner cartridge, the waste hopper assembly may be retained to the other modules by the cartridge end plates, as discussed above. In operation, the photosensitive drum 234 receives an overall charge from the primary charge roller 232; portions of the drum are then selectively discharged by modulated light from a laser (denoted by the short-and-long dashed line 140), with the pattern of charged and discharged areas corresponding to the image to be printed. The photosensitive drum then rotates past the magnetic roller 222, and toner is selectively transferred to the drum based on the levels of localized charge on the drum. The photosensitive drum then rotates past the media path as print media is moved along the path; an electric charge on transfer roller 116, positioned on the opposite side of the print media, causes the toner on the drum to be attracted to print media.

A residue of toner may remain on the photosensitive drum 234 after the bulk of the toner is transferred to the print media; this residue is ideally removed from the drum by the wiper blade 236 and is deposited in the waste toner hopper compartment 238.

A typical toner cartridge includes additional components not discussed above, such as mechanisms for stirring the toner and for sensing toner levels; the above discussion is intended only to serve as an overview.

After toner is deposited on the print media, the print media is carried along the printer media path to a fuser where the toner is "fused" to the media by a heated fixing sleeve 118 and pressure roller 120. The printed media 304 is then deposited in output media tray 130.

An exemplary toner cartridge may be engineered to print a specified number of "typical" pages, such as 10,000 or 25,000 pages, after which the supply of toner is exhausted. When a cartridge is depleted of usable toner, it may be remanufactured to restore it substantially to original specifications.

Remanufacturing the exemplary toner cartridge generally involves disassembly of the cartridge, cleaning, refurbishing, or replacing the individual components, reassembly of the cartridge, and refilling with toner.

Disassembly of the exemplary toner cartridge may begin with the separation of the waste hopper assembly 230 and related components from the remainder of the cartridge. This may involve the removal of cartridge end plates, as discussed above. The components within the waste hopper assembly, including the primary charge roller 232, the photosensitive drum 234, and the wiper blade 236, may then be removed for cleaning, refurbishing, or replacement.

Embodiments of the invention include modifying a laser printer cartridge to add a PCR cleaner. In embodiments of the invention the PCR cleaner is attached to the cartridge wiper blade assembly, and positioned such that the cleaner contacts the revolving PCR. The wiper blade may be a replacement wiper blade or a reused original wiper blade, as discussed below. The PCR cleaner is made of a material adapted to remove contaminants from the PCR, and is positioned to clean the PCR without substantially impeding the PCR's rotation.

Figure 2:
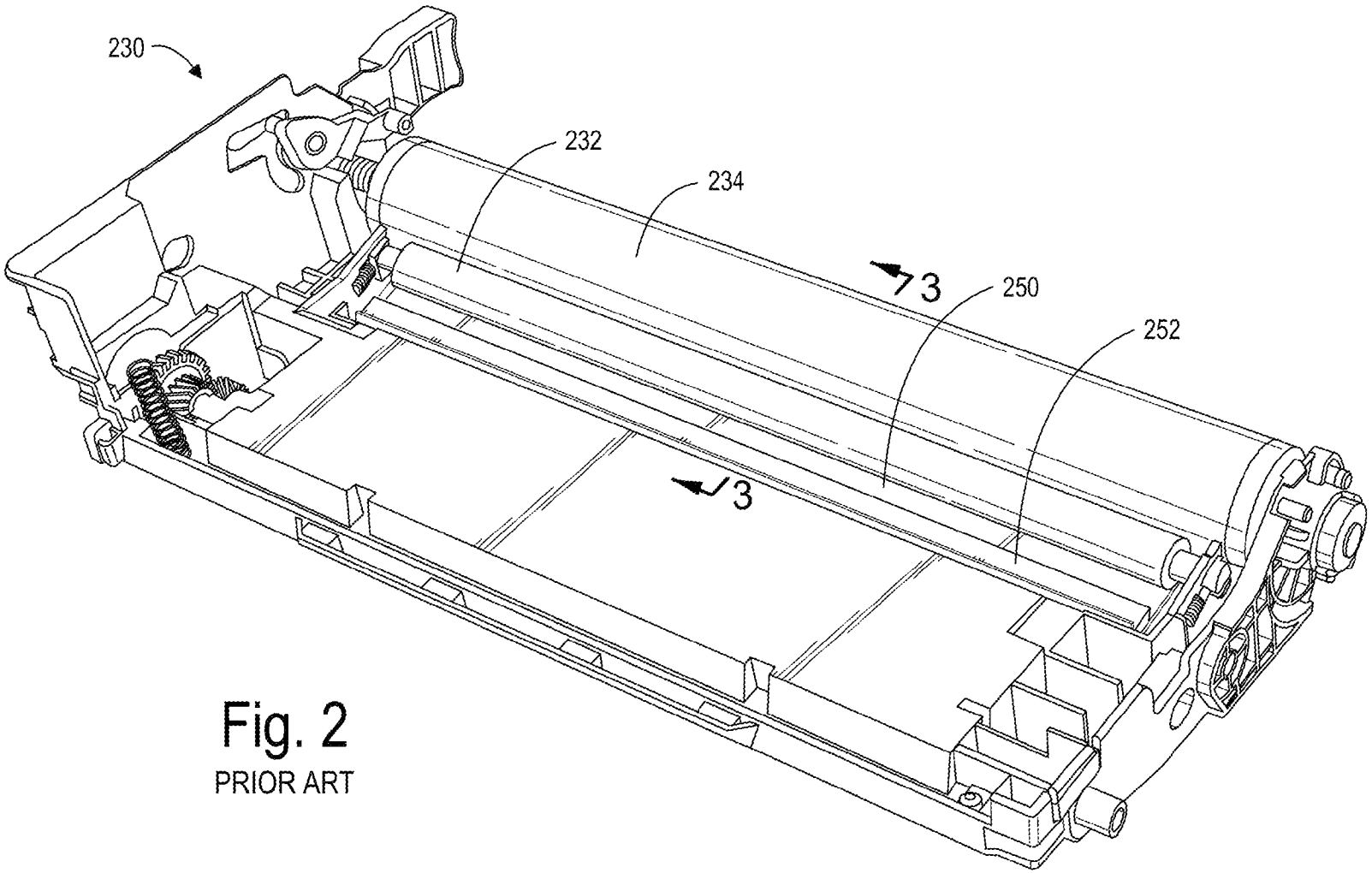
Fig. 2 PRIOR ART
FIG. 2 is a perspective view of internal components of a conventional laser printer toner cartridge, showing the photosensitive drum, cleaning blade, and PCR roller.
Figure 3:
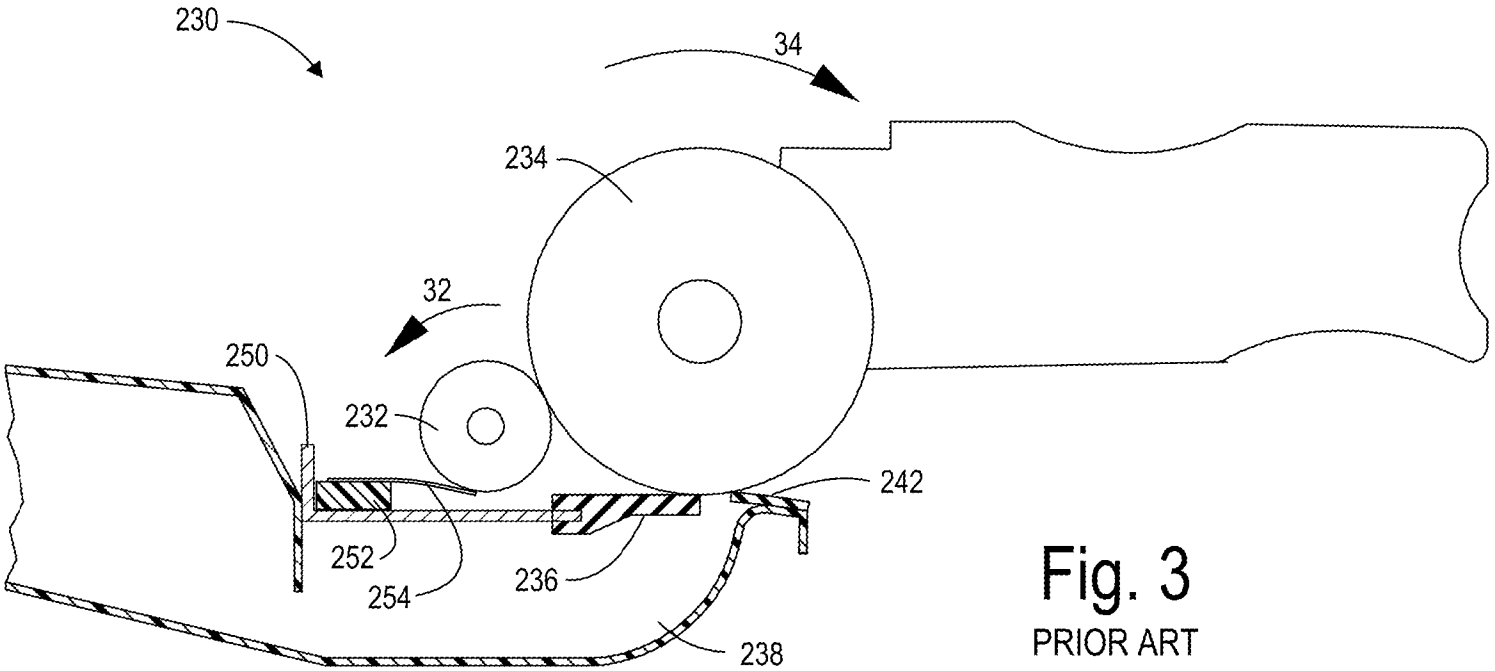
Fig. 3 PRIOR ART
FIG. 3 is a cross-sectional view of the FIG. 1 cartridge, taken along line 3-3 of FIG. 1.

Referring to FIGS. 2-3 a prior art laser printer toner cartridge waste hopper assembly 230 includes a primary charge roller (PCR) 232, a photosensitive drum 234, and a bracket 250 holding a wiper blade (the wiper blade is not visible in FIG. 2), all of which are conventional and the operation of which is known. As shown in the FIG. 3 cross-sectional view, drum 234 rotates in a clockwise direction indicated by arrow 34, and PCR 232 counter-rotates in a counter-clockwise direction shown with arrow 32. Waste hopper 238 is positioned below PCR 232 and drum 234. The waste hopper 230 includes a wiper blade assembly having an L-shaped mounting bracket 250 that functions to hold a conventional wiper blade 236 in position to wipe excess material, such as toner, from drum 234. The L-shaped bracket in the exemplary embodiment is typically held to the waste hopper by removable screws (not shown) at each end. Some brackets and wiper blades, including replacement blades, may have a more complex construction than shown in FIG. 3, while performing essentially the same function. Recovery sealing blade 242 is positioned on waste hopper 238 to prevent waste toner from escaping out of the hopper 238 in the space that would otherwise exist between drum 234 and hopper 238.

The L-shaped bracket 250 of the prior art waste wiper blade assembly may have a plastic spacer 252 adhered to its surface supporting a thin flexible film strip 254. When the wiper blade 236 is in position to clean the drum 234, the film strip 254 makes contact with the PCR 232 and provides limited cleaning of the PCR. The thin strip may, for example, be made of a material with triboelectric characteristics that allow it to "catch" stray incorrectly charged toner particles. As discussed above, the cleaning provided by the film strip has generally proven inadequate for preventing the type of PCR-related print defects observed with remanufactured cartridges, which may be due to different toner formulations and other system variables.

Figure 4:
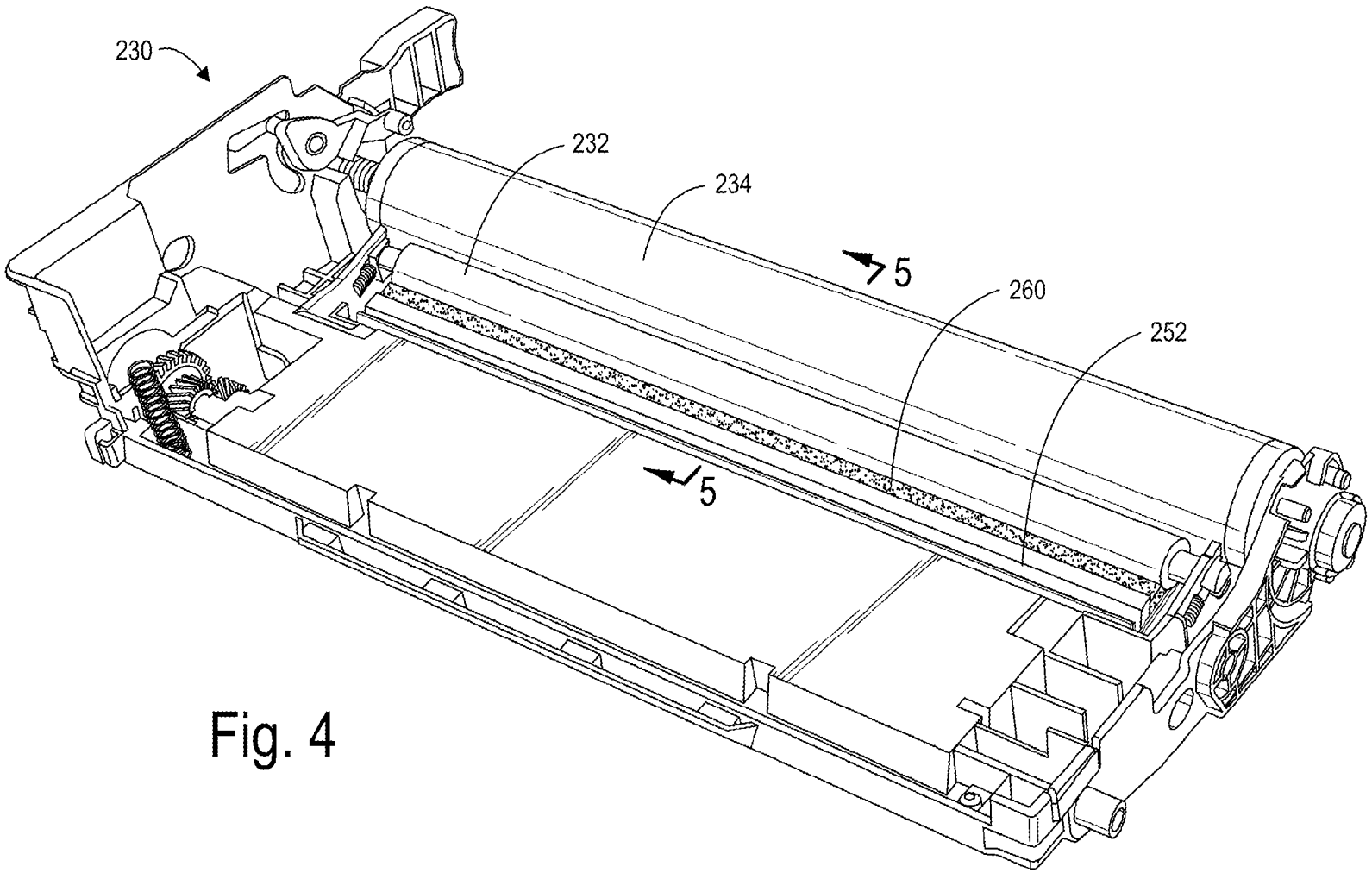
FIG. 4 is a perspective view of a first embodiment of a PCR cleaning device.
Figure 5:
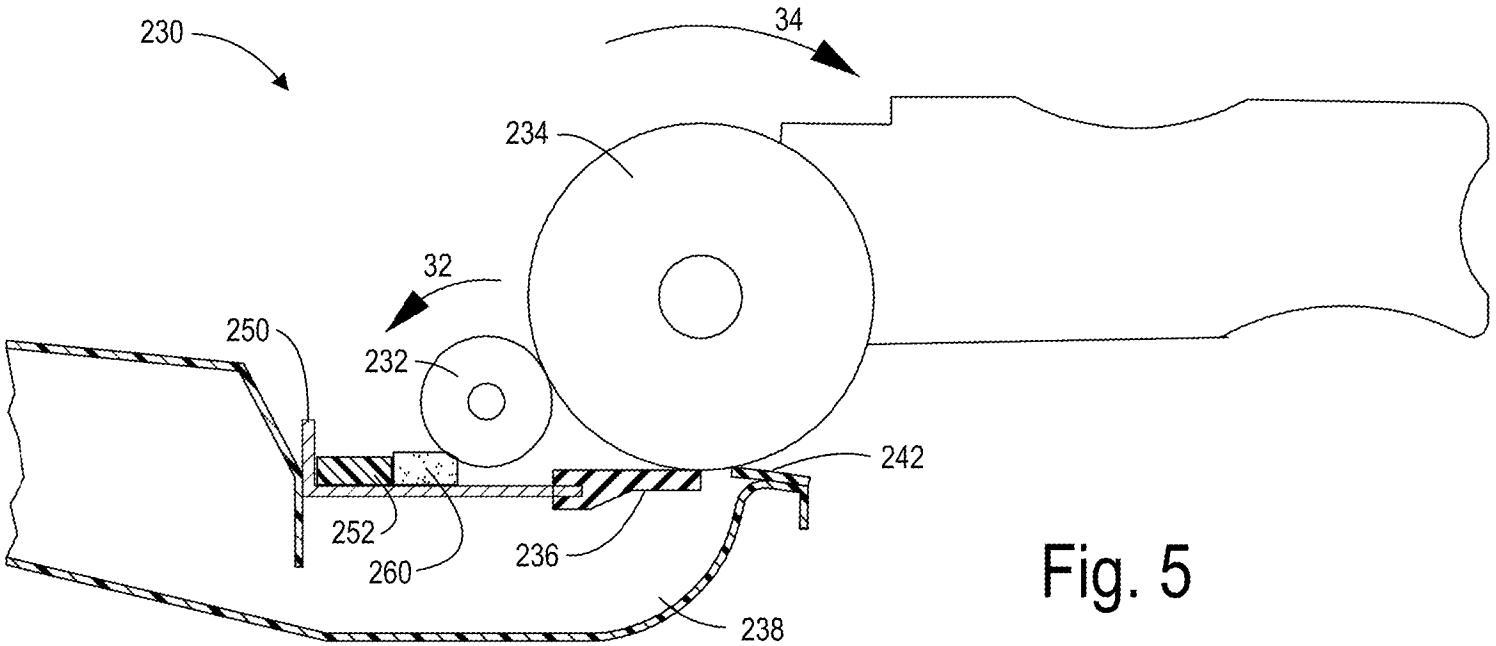
FIG. 5 is a cross-sectional view of the FIG. 4 cartridge, taken along line 5-5 of FIG. 4.

FIGS. 4-5 show the waste hopper assembly 230 of a first embodiment of a laser printer toner cartridge that includes drum 234, PCR 232 and a foam strip 260 that functions to wipe the PCR and remove additive material, i.e., the left over toner remaining on the drum 234 and/or other materials that remain on the drum 234 and are transferred to the PCR as contaminants. Embodiments of the invention contemplate removing the thin flexible film strip 254 seen in FIG. 3 (if present), while leaving the plastic spacer 252 (if present). A resilient material, such as a foam strip 260, is then added to serve as a PCR cleaner.

The foam strip 260 shown in FIGS. 4-5 may, for example, be made of an open or closed cell polyurethane material that is capable of wiping off the left-over toner additives remaining on the PCR 232 when butted up against the PCR. Also, the material used for the foam strip in this and other embodiments functions to wipe or absorb the left-over contaminant material without adversely affecting the physical or electrical properties of the PCR. The material of the strip, in this, as well as in other embodiments, is selected such that it performs the wiping or removal function over various conditions of heat and humidity, such as 50° F. and 10% relative humidity and 90° F. and 80% relative humidity.

The foam strip 260 is fastened with any conventional means, such as an adhesive, to part of the wiper blade assembly shown as L-shaped mounting bracket 250. Mechanical fastening may also be used, such as, for example, screws or clips. Alternatively to the single layer shown at 260, the foam strip may be composed of a foam layer and an adhering layer, such as double-sided adhesive tape (not show), or may be part of an assembly which is mechanically fastened to the bracket (not shown). The foam strip 260 is positioned up against the PCR 232 with sufficient force to cause substantially all of the residual toner and toner additives on PCR 232 to be removed. As shown in FIG. 5, at the interface between PCR 232 and strip 46 the edge of strip 260 may be rounded, preferably to conform to the perimeter of the PCR. While in the exemplary embodiment the material used to make the strip is a resilient closed cell foam material, other materials that can perform a cleaning function may also be used, such as, for example, a felted or velvet cloth material.

In an exemplary embodiment, bracket 250 and wiper blade 236 comprise a replacement wiper blade, as is known in the art, and the foam strip 260 is secured to the replacement blade prior to the installation of the wiper blade on the waste hopper assembly 230. In other embodiments, the bracket 250 and wiper blade 236 may comprise the original cartridge bracket and wiper blade; the foam strip may be adhered after the bracket and wiper blade have been removed from the cartridge for cleaning or other refurbishment.

Figure 6:
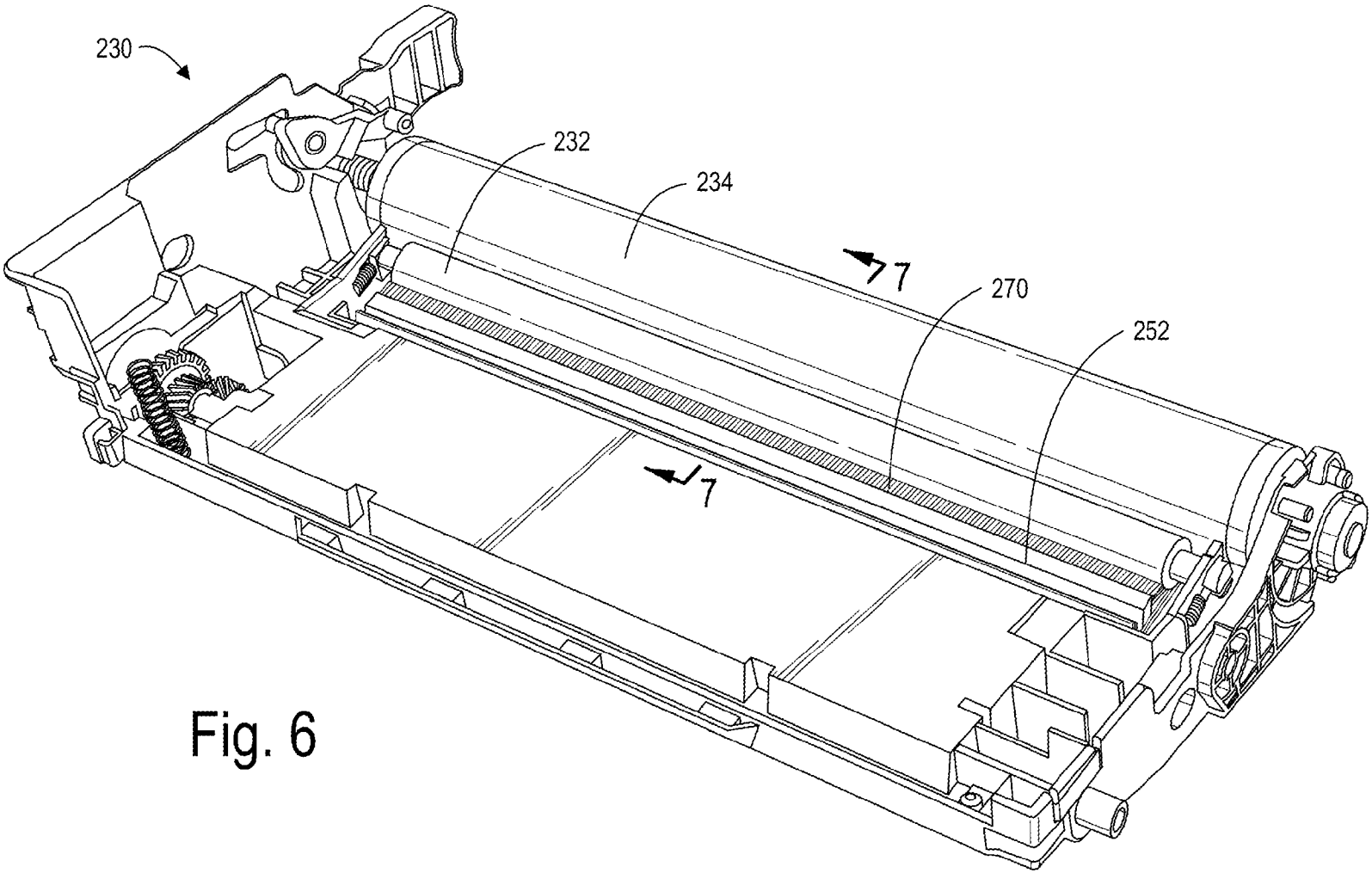
FIG. 6 is a perspective view of a second embodiment of a PCR cleaning device.
Figure 7:
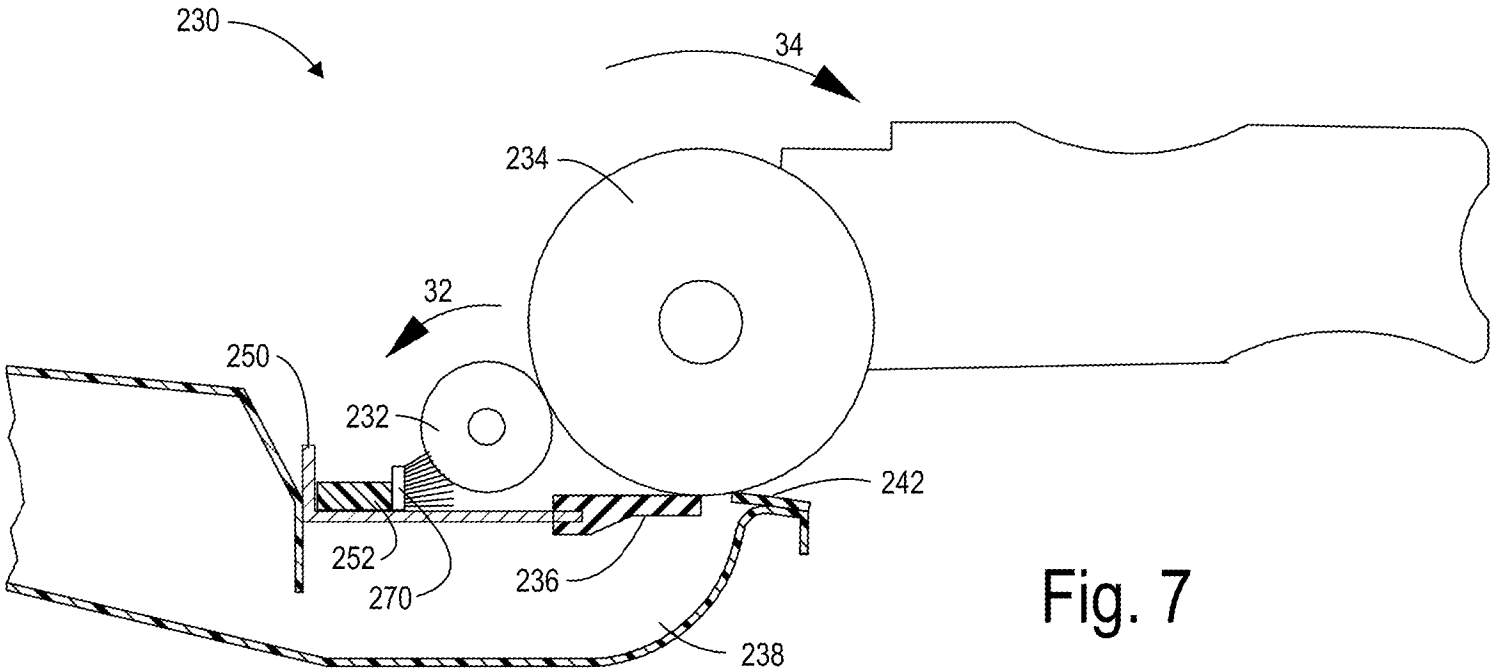
FIG. 7 is a cross-sectional view of the FIG. 6 cartridge, taken along line 7-7 of FIG. 6.

FIGS. 6-7 show the waste hopper assembly 230 of a second embodiment of a laser printer toner cartridge that includes drum 234, PCR 232 and a brush 270 that functions to remove additive material, i.e., the left over toner additive material remaining on the PCR 232 and/or other materials that remain on the PCR 232. The brush 270 is, by way of example, a nylon brush and is positioned to abut or brush up against the PCR 232, as shown FIG. 7. The brush 270 is capable of removing the left-over toner additive material remaining on the PCR 232 when abutted up against the PCR 232. In contrast to the strip 260 of the first exemplary embodiment of FIGS. 4-5, the brush 270 may not have a surface that conforms to the surface of the PCR, but rather its bristles simply are moved in the direction of rotation shown by arrow 32 in FIG. 7.

The brush 270 is fastened to the L shaped mounting bracket 250 of the wiper blade assembly by any convention method, such as adhesive, double sided tape, or mechanical fasteners. The brush 270 is positioned up against the PCR 232 with sufficient force to cause essentially all of the residual toner on PCR 232 to be removed without degrading operation of the PCR or printer.

Figure 8:
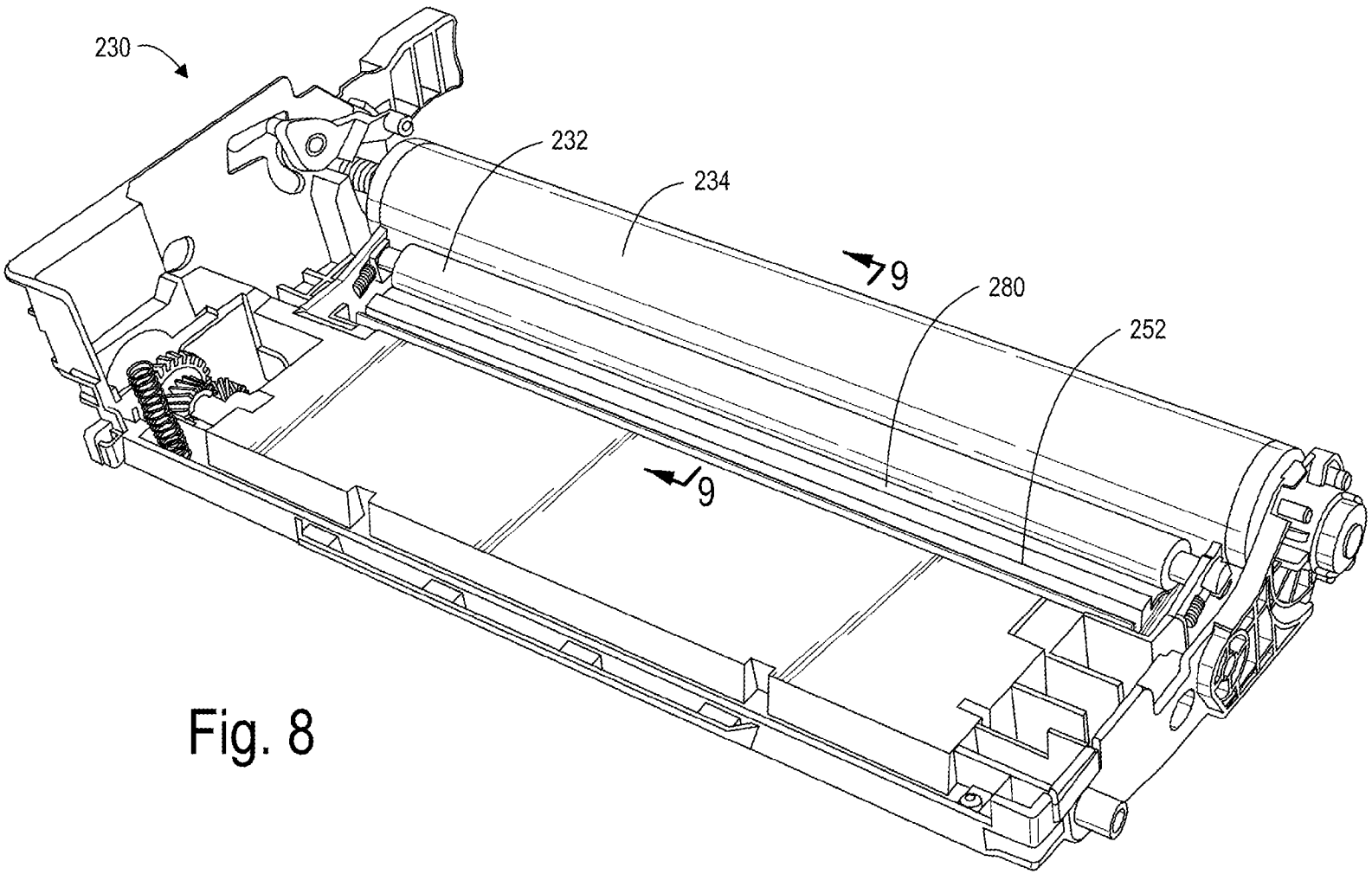
FIG. 8 is a perspective view of a third embodiment of a PCR cleaning device.
Figure 9:
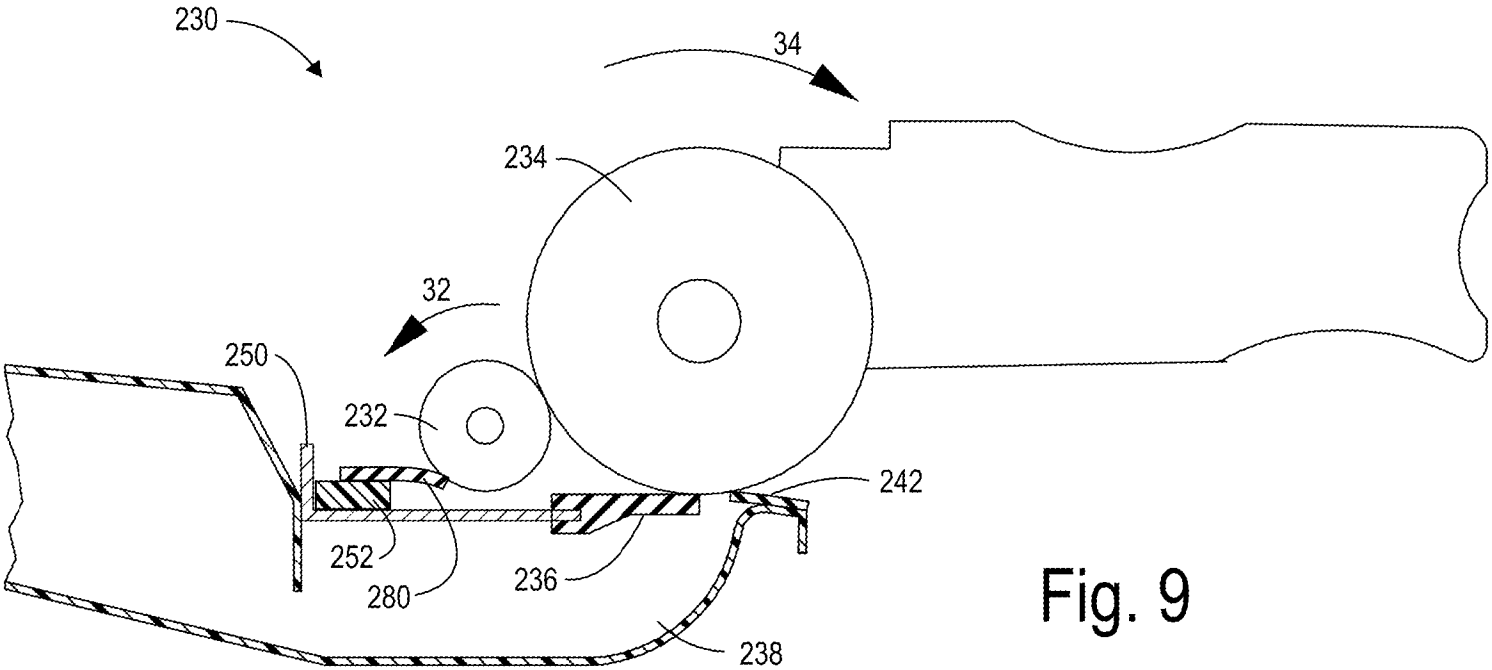
FIG. 9 is a cross-sectional view of the FIG. 8 cartridge, taken along line 9-9 of FIG. 8.

FIGS. 8-9 show the waste hopper assembly 230 of a third embodiment of a laser printer toner cartridge that includes drum 234, PCR 232 and a squeegee strip 280 that functions to wipe the PCR and remove additive material, i.e., the left over toner remaining on the PCR 232 and/or other materials that remain on PCR 232. The strip or squeegee 280 is preferably made of a solid polyurethane or silicone material that is positioned next to and to press against PCR 232. The squeegee 280 may alternatively be formed of any suitable resilient material, such as a solid, flexible silicone material or other organopolymeric material. During printer operation strip 280 bends downward in the direction of rotation of the PCR 232, as shown by direction arrow 32 in FIG. 9. The squeegee 280 is capable of wiping off the left-over toner additive material remaining on PCR 232 when abutted up against the PCR. In contrast to the strip 260 of the first exemplary embodiment of FIGS. 2-3, the solid strip or squeegee 280 preferably does not have its abutting surface conform to that of the PCR, but rather simply bends due to its flexibility.

The squeegee 280 is fastened to the L-shaped wiper blade mounting bracket 250 of the wiper blade assembly by any conventional means, such as an adhesive, double sided tape, or mechanical fasteners. The squeegee 280 is positioned up against the PCR 232 with sufficient force to cause essentially all of the residual toner on PCR 232 to be removed. As shown in FIG. 9 at the interface between PCR 232 and squeegee 280 the edge of squeegee 280 is bent downward in the direction of rotation 32, due to the resiliency of the material used to make the squeegee 280.

The wiper blade assembly may vary in construction and design details from the wiper blade assembly shown in the accompanying Figures, and the method of attaching the PCR cleaner to the wiper blade assembly may similarly vary. The materials comprising the PCR cleaner include any materials which can perform the function of removing contaminants from the PCR without degrading PCR operation or printer performance. Embodiments of the invention are intended to include any PCR cleaner added to the wiper blade in a remanufactured laser printer cartridge which functions by contact with the rotating PCR.

Further, toner cartridges differ in design and construction, and in other embodiments of the invention the PCR cleaner may be fastened to another surface within the toner cartridge, such as, for example, directly to a portion of the waste toner hopper. Embodiments of the invention thus include the addition of a PCR cleaner that cleans by rubbing contact with the PCR, or by contact in which the cleaner compresses slightly against the PCR to remove contaminants, to a remanufactured cartridge, where the original cartridge lacked such a cleaner, regardless of how the PCR cleaner is mounted within the cartridge.

As discussed above, the PCR is caused to rotate by contact with the rotating photosensitive drum. Excessive friction of the cleaning element on the PCR could potentially cause a variety of printing problems, such as inducing the wiper blade to "flip" or excessive erosion of the PCR or drum coating. Positioning of the cleaning member with respect to the PCR in embodiments of the invention is thus selected to provide adequate cleaning of the PCR without substantially adding a rotational load to the PCR or unduly impacting PCR operation.

Figure 10:
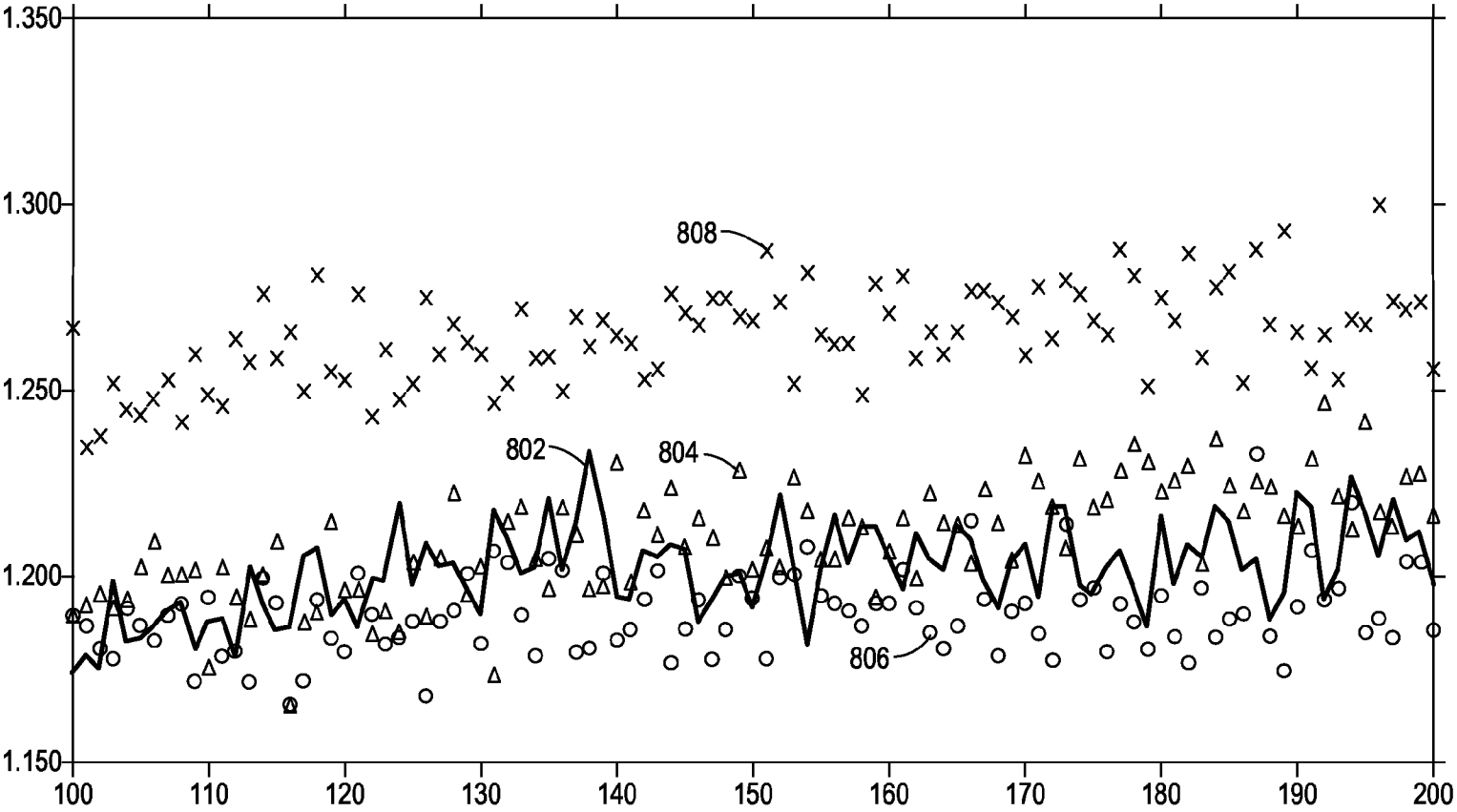
FIG. 10 shows a representative sample of measurements made of the effect of embodiments of the PCR cleaner on drum motor torque.

FIG. 10 shows a representative sample of measurements made of the effect of the added cleaning element on the drum motor torque. The positioning of the cleaning elements (foam and brush) next to the PCR or drum was evaluated using an amp load meter True RMS Multimeter (model Fluke 289). The load was measured on the drum motor of a Hewlett-Packard Company model 4600 printer. The more friction that is applied to the PCR or drum, the higher the load on the electrical motor inside the printer that is turning the drum. An optimal position was chosen for the cleaning member where good cleaning characteristics were achieved at a minimal load on the motor.

The vertical axis of FIG. 10 represents the load on the drum motor in DC milliamps; the horizontal axis represents time in milliseconds for various test runs with different cleaning members. The solid line 802 represents a test run made with no cleaning member; the triangles, as represented at 804, are measurement points with a foam cleaner; the circles, as represented at 806, are measurement points with a brush cleaner; and the X's, as represented at 808, are measurement points with a brush forced too close to the PCR.

Figure 11:
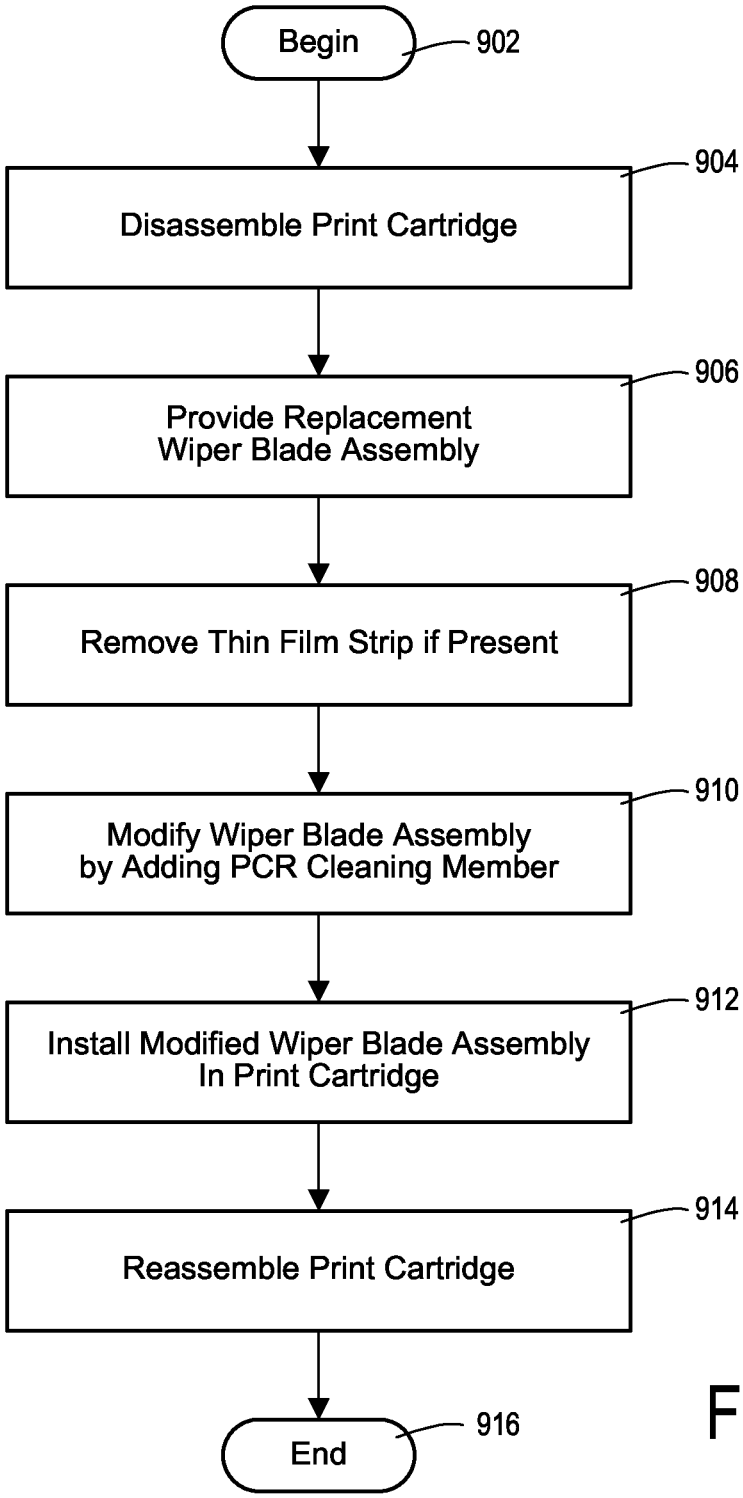
FIG. 11 is a flow diagram illustrating an exemplary method of the invention.

FIG. 11 is a flow chart of a exemplary method of the invention. The method starts 902 with disassembly 904 of a cartridge, including removal of the wiper blade assembly, as discussed above. In an exemplary embodiment of the invention, a replacement wiper blade is provided 906, although in other embodiments the original wiper blade may be cleaned and reused.

If the replacement wiper blade assembly (or reused original wiper blade assembly) includes a thin film strip intended to contact the PCR during operation, that film strip is removed 908. The wiper blade assembly is then modified 910 by the attachment of a PCR cleaning member to wiper blade assembly. The cleaning member in an exemplary embodiment is a foam strip; in other embodiments, the cleaning member may be a brush or a squeegee, or any other cleaning device that will function to remove contaminants from the PCR without interfering with the functioning of the PCR. The cleaning member may be attached to the wiper blade assembly by any convention method, such as an adhesive, double sided tape, or mechanical fasteners. The modified wiper blade assembly is then installed 912 in the cartridge, and the cartridge is reassembled 914. Reassembly of the cartridge may include using replacement parts for other components in the cartridge, as necessary, to ensure proper operation of the cartridge, and includes refilling the cartridge with a new supply of toner. The method then ends 916.

While an exemplary embodiment of the method includes the steps outlined above, other embodiments may follow an alternate sequence of steps or omit steps. For example, a cleaning member may be installed on a wiper blade assembly without physically removing the wiper blade assembly from the toner cartridge, or a cartridge may be obtained already in a disassembled state, or left disassembled after modification. It is the intent of the applicants that methods of the invention include all methods which result in the addition of a PCR cleaning member to the wiper blade assembly of a remanufactured laser printer toner cartridge, however achieved, as recited in the claims.

Although specific embodiments of the invention have been described, various modifications, alterations, alternative constructions, and equivalents are also encompassed within the scope of the invention. The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method of remanufacturing a laser printer toner cartridge, the toner cartridge having a primary charge roller and a wiper blade assembly, the method comprising:

disassembling a laser printer toner cartridge to remove the wiper blade assembly;

providing a replacement wiper blade assembly, the replacement wiper blade assembly including a mounting bracket;

modifying the replacement wiper blade assembly by fastening a primary charge roller cleaning member to the wiper blade assembly mounting bracket, the primary charge roller cleaning member adapted to remove contaminants from the primary charge roller through contact with the roller;

installing the modified replacement wiper blade assembly in the toner cartridge; and substantially reassembling the laser printer toner cartridge.

2. The method of remanufacturing a laser printer toner cartridge of claim 1, wherein the primary charge roller cleaning member comprises a foam strip.

3. The method of remanufacturing a laser printer toner cartridge of claim 2, wherein the foam strip comprises polyurethane foam.

4. The method of remanufacturing a laser printer toner cartridge of claim 1, wherein the primary charge roller cleaning member comprises a brush.

5. The method of remanufacturing a laser printer toner cartridge of claim 1, wherein the primary charge roller cleaning member comprises a squeegee.

6. The method of remanufacturing a laser printer toner cartridge of claim 1, wherein modifying the replacement wiper blade assembly by fastening a primary charge roller cleaning member to the replacement wiper blade assembly mounting bracket comprises adhering the primary charge roller cleaning member to the replacement wiper blade assembly mounting bracket with an adhesive.

7. The method of remanufacturing a laser printer toner cartridge of claim 1, wherein the replacement wiper blade assembly has a thin film strip adhered thereto, the method further comprising removing the thin film strip.

8. The method of remanufacturing a laser printer toner cartridge of claim 1, wherein modifying the replacement wiper blade assembly by fastening a primary charge roller cleaning member to the wiper blade assembly mounting bracket comprises positioning the primary charge roller cleaning member at a location on the wiper blade assembly mounting bracket such that when the toner cartridge is substantially reassembled the cleaning member contacts the primary charge roller but does not substantially add a rotational load to the primary charge roller.

9. A method of remanufacturing a laser printer toner cartridge, comprising:

removing an original wiper blade assembly, the original wiper blade assembly having a mounting bracket, the mounting bracket lacking a primary charge roller cleaning device operable to remove contaminants from a primary charge roller by contact therewith;

installing a replacement wiper blade assembly, the replacement wiper blade assembly having a mounting bracket, the mounting bracket having a primary charge roller cleaning device operable to remove contaminants from a primary charge roller by contact therewith.

10. The method of remanufacturing a laser printer toner cartridge of claim 9, wherein the primary charge roller cleaning device comprises a foam strip.

11. A remanufactured previously used laser printer toner cartridge, the previously used laser printer toner cartridge lacking a primary charge roller cleaner that compresses against the primary charge roller to remove contaminants, the remanufactured previously used laser printer toner cartridge comprising:

a previously used photosensitive drum;

a previously used primary charge roller in contact with the photosensitive drum;

an added primary charge roller cleaner slightly compressed against the primary charge roller.

12. The remanufactured previously used laser printer toner cartridge of claim 11 further comprising a wiper blade assembly, the wiper blade assembly having a mounting bracket and a wiper blade adapted to clean toner from the photosensitive drum, and wherein the added primary charge roller cleaner is fastened to wiper assembly blade mounting bracket.

13. The remanufactured laser printer toner cartridge of claim 12, wherein the added primary charge roller cleaner comprises a foam strip.

14. The remanufactured laser printer toner cartridge of claim 12, wherein the added primary charge roller cleaner comprises a brush.

15. The remanufactured laser printer toner cartridge of claim 12, wherein the added primary charge roller cleaner comprises a squeegee.

16. The remanufactured laser printer toner cartridge of claim 12, wherein the added primary charge roller cleaner is adhered to the wiper blade assembly mounting bracket with an adhesive.

17. The remanufactured laser printer toner cartridge of claim 11, wherein the added primary charge roller cleaner comprises a foam strip.

18. The remanufactured laser printer toner cartridge of claim 17, wherein the foam strip comprises a closed cell polyurethane foam.

19. The remanufactured laser printer toner cartridge of claim 11, wherein the added primary charge roller cleaner comprises a brush.

20. The remanufactured laser printer toner cartridge of claim 11, wherein the added primary charge roller cleaner comprises a squeegee.

* * * * *